United States Patent [19]

von Linde et al.

[11] 4,090,839

[45] May 23, 1978

[54] BURNER UNITS FOR FLUID FUELS

[76] Inventors: Robert von Linde, Akilindastrasse 56; Joachim von Linde, Akilindastrasse 52b, both of Gräfelfing; German Kurz, Südenstrasse 31, Karlsfeld, all of Germany

[21] Appl. No.: 730,317

[22] Filed: Oct. 7, 1976

[51] Int. Cl.[2] ..... F23N 3/02

[52] U.S. Cl. ..... 431/89; 431/116

[58] Field of Search ..... 431/89, 90, 115, 116

[56] References Cited

U.S. PATENT DOCUMENTS

| | | | |
|---|---|---|---|
| 3,269,448 | 8/1966 | Martin | 431/116 |
| 3,869,244 | 3/1975 | von Linde et al. | 431/116 |
| 3,994,665 | 11/1976 | Young | 431/116 |
| 4,003,691 | 1/1977 | Wormser | 431/116 |

FOREIGN PATENT DOCUMENTS

| | | | |
|---|---|---|---|
| 1,108,358 | 8/1955 | France | 431/90 |
| 766,603 | 1/1957 | United Kingdom | 431/115 |

*Primary Examiner*—Carroll B. Dority, Jr.
*Attorney, Agent, or Firm*—Kane, Dalsimer, Kane, Sullivan and Kurucz

[57] ABSTRACT

Burner units for fluid fuels such as oil or gas include a combustion chamber, a prechamber, means to enable combustion gases to recirculate from the combustion chamber to the prechamber, a mixing chamber in communication with the prechamber and the combustion chamber, a fuel nozzle for distributing fuel into the recirculated combustion gases and means including an air nozzle for supplying combustion air to the mixture of fuel and combustion gases whereby the energy of the air jet emerging from the air nozzle forms at least partially the means for recirculating the combustion gases.

11 Claims, 4 Drawing Figures

BURNER UNITS FOR FLUID FUELS

BACKGROUND OF THE INVENTION

The main advantage of burners in which the fuel is mixed with the hot combustion gases prior to the admixture of combustion air is the fact that the fuel is preheated and diluted with combustion gases and to a certain part decomposed before it comes in contact with the combustion air. This improves combustion considerably.

While such burners work satisfactory at constant output, difficulties are encountered if a wide range or operation is desired. Owing to the fact that the volume of the recirculated combustion gases changes with the velocity or volume of the combustion air no sufficient volume of combustion gases is recirculated at low loads (where also the volume of combustion air is small) although a greater amount of recirculated combustion gases would be desirable.

SUMMARY OF THE INVENTION

It is an object of the present invention to provide a burner unit of the type set forth which can operate satisfactorily over a broad range and especially also at low loads.

It is a further object of the present invention to provide an infinitely variable adjustment of the burner output.

With these and other objects in mind the invention proposes a burner unit of the type set forth including means for varying the fuel supplied to the fuel nozzle and means for supplying a variable volume of air under pressure to the air nozzle and means for varying the cross-sectional area of said air nozzle in dependence on the volume of air passing therethrough such that the cross-sectional area decreases when the volume of air decreases. Preferably the cross-sectional area is adjusted in such a way that the exit velocity of the air jet is substantially constant over the whole operating range of the burner.

As the ratio between fuel and air is substantially constant irrespective of the possibility to burn sub- and over-stoichiometric mixtures it is possible to adjust the cross-sectional area of the air nozzle in dependence on the amount of fuel supplied to the fuel nozzle or on the volume of air supplied to the air nozzle. The amount of fuel and the volume of air may be adjusted manually or an automatic control may be provided for adjusting the amount of fuel in dependence on the volume of air or vice versa. In this context the expression "air" is intended to include any oxygen-containing gas.

Further objects, features and advantages of the present invention will become apparent from the following description in connection with the drawings which show, for purposes of illustration only, some embodiments in accordance with the present invention.

DETAILED DESCRIPTION

Figure 1:
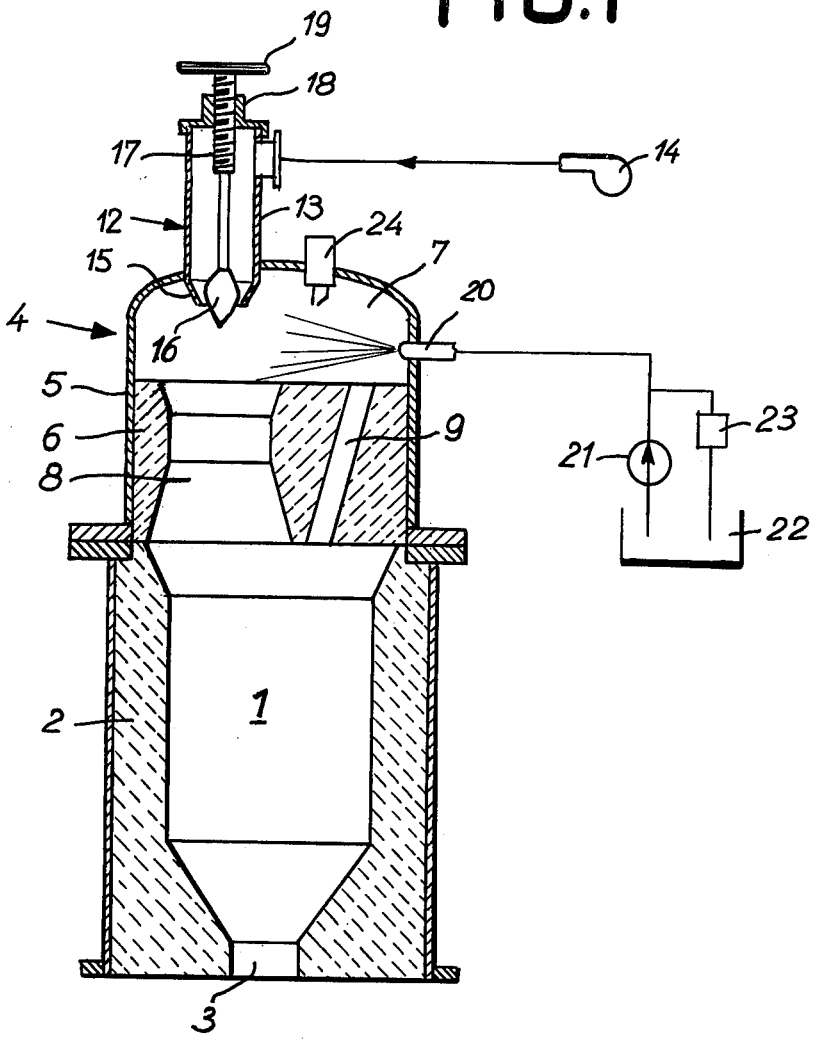
FIG. 1 is a schematic representation of a burner unit including a sectional elevational view of the burner proper according to a first embodiment of the invention.

Referring now to FIG. 1, reference numeral 1 designates a combustion chamber having a refractory lining 2 and an outlet opening 3 for the burnt gases. The combustion chamber 1 is flanged to a burner assembly generally designated 4 comprising an outer shell 5 and a refractory insert 6. The insert 6 delimits with the outer shell 5 a prechamber 7 and is provided with a mixing chamber 8 which connects the prechamber 7 with the combustion chamber 1. The insert 6 is also provided with at least one passage 9 for recirculation of combustion gases as will be explained hereinafter. An air nozzle 12 is arranged within the outer shell 5 coaxial with the longitudinal axis of the mixing chamber 8 and opening into the prechamber 7. The air nozzle 12 comprises an air pipe 13 connected to a blower 14. Pipe 13 has a tapered outlet portion 15 which accommodates a conical valve member 16 which is connected to a spindle 17 extending through a threaded sleeve 18 and carrying at its outer end a hand wheel 19. By turning of hand wheel 19 the spindle 17 and therewith the valve member 16 can be adjusted longitudinally to vary the cross-sectional area of the air nozzle 12. A fuel nozzle 20 is arranged in the prechamber 7 close to the outlet end of passage 9. Fuel is supplied to fuel nozzle 20 by a pump 21 which sucks fuel from a tank 22. The fuel pressure can be adjusted by a pressure control valve 23. A spark plug 24 is also arranged in prechamber 7.

In operation, the combustion air is supplied by blower 14 to pipe 13 and through the annular space between the inner surface of outlet portion 15 and outer surface of valve member 16 into prechamber 7. By the injector effect of the air jet emerging from air nozzle 12 combustion gases are sucked back from the combustion chamber 1 through the passages 9 into prechamber 7 where they are mixed with the fuel emerging from fuel nozzle 20. The finely divided fuel is preheated and reacts with the hot combustion gases whereby reaction products of a precombustion are formed. These products are delivered into the mixing chamber 8 by the air jet and are mixed with air. The mixture of fuel, recirculated gases and air enters the combustion chamber 1 and is ignited by the flame vortex present within the combustion chamber 1. Naturally the first ignition is effected in usual way by spark plug 24 (or a pilot burner).

According to the desired capacity of the burner, the valve member 16 is adjusted by turning hand wheel 19 thereby varying the cross-sectional area of the annular gap of air nozzle 12 and therewith the volume of air thereby maintaining the velocity of the air at the exit of the air nozzle 12 substantially constant. Accordingly also a corresponding volume of combustion gases is recirculated. At the same time, naturally also the fuel quantity must be varied by actuation of the pressure control valve 23 to maintain the desired fuel-air ratio. Hand wheel 19 could be replaced by an electromotor (not shown) for driving spindle 17. If blower 14 is driven with variable speed, means may be provided for actuating the electromotor in dependence on the speed of the blower in order to keep the air velocity in the air nozzle constant.

Figure 2:
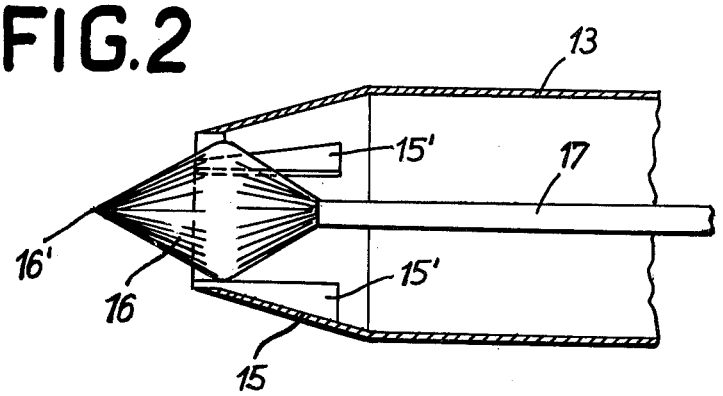
FIG. 2 is a sectional elevational view of the air nozzle of FIG. 1 on an enlarged scale.

FIG. 2 shows on an enlarged scale, the air nozzle of FIG. 1. As can be seen the angle of taper of the tapered outlet portion 15 is smaller than the angle of taper of the conical valve member 16, and the valve member 16 has a tip 16' which prevents the generation of eddies after the air has passed the narrowest portion of the air nozzle. The angles of taper are chosen such that the cross-sectional area of the annular gap between the inner surface of portion 15 and the outer surface of valve member 16 is not increased downstream of the narrowest spot when the valve member 16 is moved axially. The inner surface of protion 15 is provided with three equally spaced ribs 15' which guide valve member 16 and prevent lateral shifting thereof.

Figure 3:
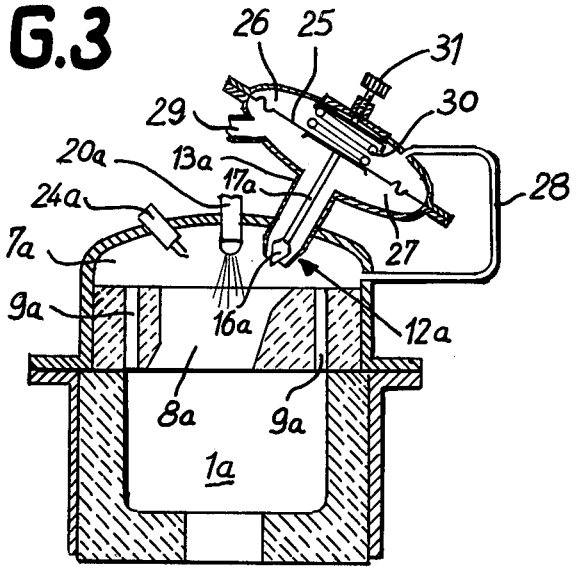
FIG. 3 is a sectional elevational view of a second embodiment of a burner according to the invention.

In the embodiment of FIG. 3 like or similar parts are designated with the same references as in FIG. 1, but with an index *a*. In this embodiment the rod 17*a* of valve member 16*a* is connected to a diaphragm 25 between two chambers 26 and 27. Chamber 26 is connected by pipe 28 to prechamber 7*a*, and chamber 27 is connected by pipe 29 to the blower 14 of FIG. 1. The air pipe 13*a* is also in communication with chamber 27. Thus diaphragm 25 is subjected to the pressure gradient across the air nozzle 12*a*. A spring 30 which is adjustable by screw 31 acts upon diaphragm 25 in addition to the pressure in chamber 26 to shift valve member 16*a* towards the closing position. Valve member 16*a* is moved axially by the diaphragm 25 in such way that a constant pressure gradient prevails across air nozzle 12*a* irrespective of the volume of air delivered by the blower. The value of the pressure gradient is determined by the bias of spring 30. In this case, the volume of air delivered by the blower is adjusted f.i. by varying the speed of the blower.

In this embodiment the fuel nozzle 20*a* and the air nozzle 12*a* are arranged side-by-side whereby the axis of the air nozzle 12*a* is inclined to the axis of the fuel nozzle 20*a* and intersects the latter in the mixing chamber 8*a*. As in the first embodiment the air jet emerging from air nozzle 12*a* creates an injector effect by which combustion gases are sucked back from the combustion chamber 1*a* via passages 9*a* into prechamber 7*a* where they are mixed with the fuel injected through fuel nozzle 20*a*.

Figure 4:
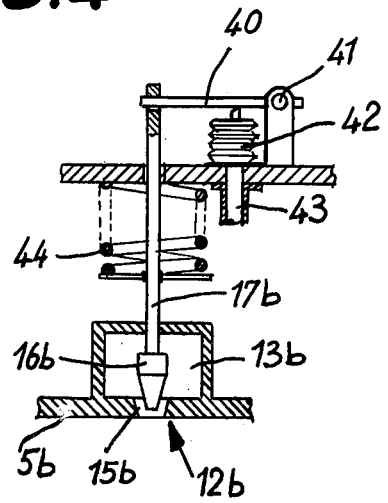
FIG. 4 is a diagrammatic view of a modified control of the cross-sectional area of the air nozzle in dependence on fuel pressure.

In the embodiment of FIG. 4 like or similar parts are designated with the same reference as in FIG. 1 but with the index *b*. In this embodiment the adjustment of valve member 16*b* is effected by the atomizing pressure of the fuel. To this end, the rod 17*b* of valve member 16*b* is articulated to a lever 40 which is journaled at 41 and which is acted upon by a bellows 42 connected by a pipe 43 to the fuel pipe which leads to the fuel nozzle. A spring system 44 acts on valve rod 17*a* with the tendency to shift valve member 16*a* to its closing position. The fuel pressure acting in bellows 42 shifts the valve member 16*a* against the action of spring system 44 thereby varying the annular gap of air nozzle 12*b*. The spring system 44 is tuned in such a way to the forces exerted by the fuel pressure that the fuel quantity and the adjusted cross-sectional area of the air nozzle are proportional to each other.

The present invention enlarges the field of application of the burners with recirculated combustion gases considerably and enables its use also in those cases where they could not yet be used owing to their small range of adjustment or owing to varying air volumes. It is a further advantage of this burner that the energy of the combustion gases leaving the combustion chamber through the outlet opening 3 in FIG. 1 is considerably increased by the higher jet energy of the combustion air when entering the mixing chamber. A very important application is the use of such burners for delivering hot pressurized gases to expansion machines used as prime movers where controllability of the output is predominant. Furthermore, the invention enables burners which can be operated under widely varying higher pressures (f.i. 10 to 20 bar) over a large range of operation.

Thus the several aforenoted objects and advantages are most effectively attained. Although several somewhat reserved embodiments have been disclosed and described in detail herein, it should be understood that this invention is in no sense limited thereby and its scope is to be determined by that of the appended claims.

What is claimed is:

1. A burner unit comprising combustion chamber means, prechamber means, means to enable combustion gases to recirculate from said combustion chamber means into said prechamber means, mixing chamber means in communication with said prechamber means and said combustion chamber means, a fuel supply nozzle for distributing fuel into said recirculated combustion gases, said fuel nozzle being associated with control means for varying the fuel supplied thereto, and means including an air nozzle for supplying air to the mixture of fuel and combustion gases, with the energy of the air jet emerging from the air nozzle forming at least partially the means for recirculating the combustion gases, wherein the means for supplying air include means for supplying a variable volume of air under pressure to said air nozzle and means for varying the cross-sectional area of said air nozzle in dependence on the volume of air passing therethrough such that the cross-sectional area of the air nozzle decreases when the volume of air decreases.

2. A burner unit according to claim 1, wherein the means for varying the cross-sectional area of the air nozzle are designed such that a constant pressure gradient prevails across the air nozzle irrespective of the volume of air passing through the air nozzle.

3. A burner unit according to claim 1, wherein said means for varying the cross-sectional area of the air nozzle comprises means responsive to the pressure gradient across the air nozzle.

4. A burner unit according to claim 1, wherein said air nozzle comprises a pipe having a tapered outlet portion and a conical valve member arranged within said portion and movable longitudinally by said means, the narrowest annular space between the inner wall of said outlet portion and the outer surface of said member defining said cross-sectional area.

5. A burner unit according to claim 4, wherein a diaphragm is arranged between two chambers one of which being connected to the air pipe upstream of the air nozzle and the other being connected to the prechamber, and said member is connected to the diaphragm.

6. A burner unit according to claim 5, wherein a blower is provided for delivering the combustion air and includes a delivery line, and one chamber is in communication with the delivery line of the blower delivering the combustion air.

7. A burner unit according to claim 5, and an adjustable spring acts on the diaphragm in addition to the pressure in the other chamber.

8. A burner unit according to claim 4, wherein at least three guide ribs for the valve member are arranged on the inner surface of said outlet portion longitudinally thereof.

9. A burner unit according to claim 4, wherein the angle of taper of the tapered outlet portion is smaller than the angle of taper of the conical valve member and that the valve member has a tip for obtaining a substantial laminar flow of the air downstream of the restriction of the air nozzle.

10. A burner unit according to claim 1, wherein the longitudinal axis of the air nozzle is inclined to the longitudinal axis of the fuel nozzle.

11. A burner unit according to claim 10, wherein said nozzles are arranged side-by-side.

* * * * *